US009669537B2

(12) United States Patent
Hartman

(10) Patent No.: US 9,669,537 B2
(45) Date of Patent: Jun. 6, 2017

(54) ADJUSTABLE TOOL EXTENDER

(71) Applicant: Chad Hartman, Sour Lake, TX (US)

(72) Inventor: Chad Hartman, Sour Lake, TX (US)

( * ) Notice: Subject to any disclaimer, the term of this patent is extended or adjusted under 35 U.S.C. 154(b) by 285 days.

(21) Appl. No.: 14/283,505

(22) Filed: May 21, 2014

(65) Prior Publication Data

US 2015/0336259 A1 Nov. 26, 2015

(51) Int. Cl.

| | |
|---|---|
| ***B25G 1/04*** | (2006.01) |
| ***B25B 13/06*** | (2006.01) |
| ***B25B 13/48*** | (2006.01) |
| ***B25B 23/00*** | (2006.01) |

(52) U.S. Cl.

CPC ..... *B25G 1/043* (2013.01); *B25B 13/06* (2013.01); *B25B 23/0021* (2013.01)

(58) Field of Classification Search

CPC ..... B25G 1/04; B25G 1/043; B25B 13/06; B25B 23/0021

USPC ..... 81/177.2

See application file for complete search history.

(56) References Cited

U.S. PATENT DOCUMENTS 1,775,402 A * 9/1930 Mandl ..... B25B 13/56 81/177.75
2,382,291 A * 8/1945 Carlberg ..... B25G 1/043 16/429
2,438,633 A * 3/1948 Condor ..... B25B 23/0021 403/107
2,893,765 A * 7/1959 Lyon ..... B25G 1/043 403/107
2,963,930 A * 12/1960 Clothier ..... B25G 1/043 285/303
3,306,639 A * 2/1967 Lyon ..... B25G 1/043 16/429
3,343,434 A * 9/1967 Schroeder ..... B23B 45/06 81/177.2
3,832,916 A * 9/1974 Schoeps ..... B25B 23/0021 81/464
4,004,476 A * 1/1977 DeVrou ..... B25B 23/0021 16/431
4,102,375 A * 7/1978 Rossini ..... B25B 15/02 279/79
4,317,393 A * 3/1982 Graffam ..... B25B 23/0021 403/107
4,344,340 A * 8/1982 Erickson ..... B25B 13/481 81/177.2
4,367,663 A * 1/1983 Merics ..... B25B 13/481 403/377
4,376,397 A * 3/1983 Newby ..... B25B 13/481 16/429
4,703,677 A * 11/1987 Rossini ..... B25B 23/0021 81/168
4,754,670 A * 7/1988 Raymond ..... B25B 13/06 81/177.2

(Continued)

*Primary Examiner* — David B Thomas

(74) *Attorney, Agent, or Firm* — The Law Office of Jerry D. Haynes

(57) ABSTRACT

An adjustable tool extender comprising an elongated body, where the elongated body is divided between a handle and an extendable drive; an engaging end at a far end of the extendable drive, where the engaging end fits into a tool bit; a receiving end at a far end of the handle, where the receiving end receives a drive on a tool; and a means for locking along the handle, where the means for locking extends the extendable drive a distance from the handle.

7 Claims, 1 Drawing Sheet

(56) References Cited

U.S. PATENT DOCUMENTS

| | | | | | |
|---|---|---|---|---|---|
| 4,856,388 | A * | 8/1989 | Freeman | B25G 1/043 | 81/177.2 |
| 4,905,548 | A * | 3/1990 | Colace | B25B 13/481 | 81/177.2 |
| 4,960,015 | A * | 10/1990 | Mathews | B25B 13/481 | 16/429 |
| 5,138,911 | A * | 8/1992 | Lan | B25G 1/043 | 403/108 |
| 5,168,782 | A * | 12/1992 | Cromwell | B25B 23/0021 | 81/177.2 |
| 5,361,655 | A * | 11/1994 | Fowlkes | B25B 23/0021 | 403/107 |
| 5,690,006 | A * | 11/1997 | Pulliam | B25B 23/0021 | 403/326 |
| 5,927,161 | A * | 7/1999 | Clifford | B25B 23/0021 | 81/177.2 |
| 5,943,924 | A * | 8/1999 | Jarvis | B25B 23/0021 | 81/177.2 |
| 6,038,946 | A * | 3/2000 | Jackson | B25B 23/0021 | 81/177.2 |
| 6,883,402 | B2 * | 4/2005 | Cerda | B25B 13/461 | 81/177.1 |
| 6,971,290 | B1 * | 12/2005 | Ybarra | B25B 23/0021 | 403/109.3 |
| 7,182,000 | B1 * | 2/2007 | Dicksen | B25G 1/005 | 81/177.2 |
| 7,188,553 | B1 * | 3/2007 | Pryor | B25G 1/043 | 81/177.2 |
| 8,534,165 | B2 * | 9/2013 | Wente | B25G 1/043 | 248/188.5 |
| 8,667,871 | B2 * | 3/2014 | Ahrens | B25B 23/0021 | 81/177.2 |
| 2014/0260829 | A1 * | 9/2014 | Alfinito | B25B 23/0021 | 81/177.2 |

* cited by examiner

ADJUSTABLE TOOL EXTENDER

BACKGROUND OF THE INVENTION

Field of the Invention

The present invention relates to a tool extender to lengthen or shorten the reach of a tool thereby enabling use of the tool in hard to reach areas.

Description of Related Art

Screwdrivers, ratchet wrenches, and lug wrenches are all torque based tools that require twisting and turning of the tool handle to loosen or tighten bolts, screws or similar items. A common problem with torque tools relates to insufficient length, and thus the torque tool does not reach the screw or nut head. Another problem relates to other items in the way or the angle at which the nut is positioned prevents the tool from reaching.

A few solutions to this problem have been presented. First, some tool manufacturers make short or extra-long tools to allow the tool to fit into these restricted areas. Alternatively, socket extenders were developed to enable a socket wrench to reach into tight or difficult to reach areas. These extenders fit onto the drive of the wrench and are then fitted into the tool tip that is already attached to the nut, thereby enabling twisting that was previously impossible. The extenders are available in fixed lengths to accommodate work areas of varying sizes. A problem encountered with these extenders is that an entire set of widely varying lengths is necessary in the tool box to ensure that socket wrench will fit. It is often cumbersome and a hassle to carry so many accessory pieces for a single tool. Therefore, it would be beneficial in the art to provide a tool extender that accommodates lengths as needed by the user.

SUMMARY OF THE INVENTION

In view of the foregoing disadvantages inherent in the prior art, the general purpose of the present invention is to provide an adjustable tool extender, configured to include all of the advantages of the prior art, and to overcome the drawbacks inherent therein.

Accordingly, an object of the present invention is to provide an adjustable tool extender that enables use of a socket wrench in hard to reach areas, and use of the same extender for work spaces of varying length.

To achieve the above objects, in an aspect of the present invention, an adjustable tool extender is described comprising an elongated body, where the elongated body is divided between a handle and an extendable drive; an engaging end at a far end of the extendable drive, where the engaging end fits into a tool bit; a receiving end at a far end of the handle, where the receiving end receives a drive on a tool; and a means for locking along the handle, where the means for locking extends the extendable drive a distance from the handle.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWING

The advantages and features of the present invention will become better understood with reference to the following detailed description and claims taken in conjunction with the accompanying drawing in which:

DETAILED DESCRIPTION OF THE DRAWINGS

Figures 1, 1A:
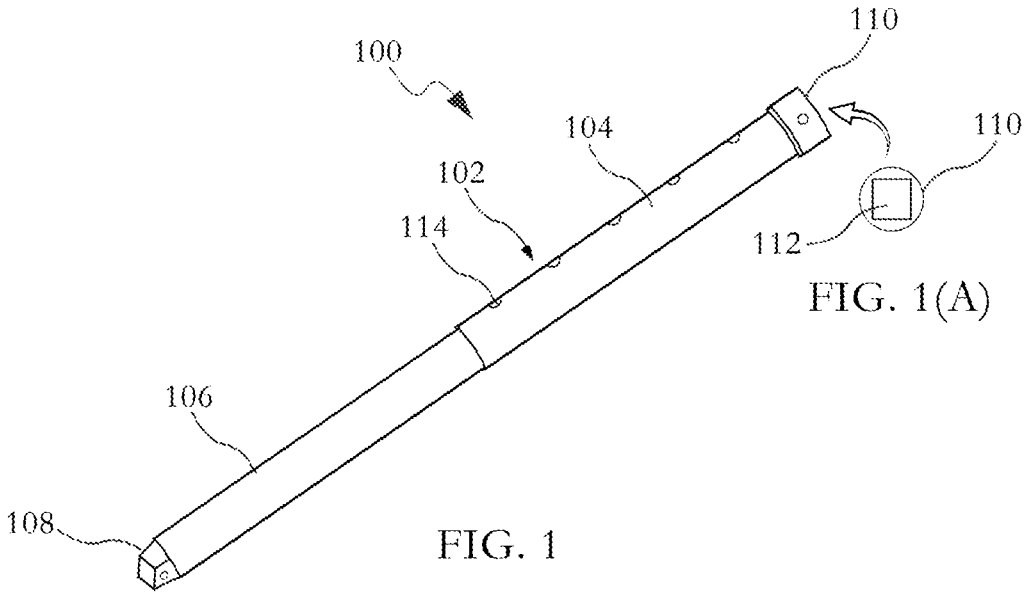
FIG. 1 depicts a perspective view of an adjustable tool extender in accordance with an exemplary embodiment of the present invention.
FIG. 1(A) illustrates a front view of a receiving end to receive the head of a socket wrench.

The present invention relates to a tool extender to lengthen or shorten the reach of a tool thereby enabling use of the tool in hard to reach areas. The present invention provides an adjustable tool extender to give consumers a product that eliminates the requirement of multiple extensions when using a socket wrench in hard to reach areas. The adjustable tool extender comprises an elongated body divided between a handle and an extendable drive. The drive locks into varying lengths making it useful for hard to reach environments. The drive is designed with multiple locking positions within the handle and a quick release mechanism. The adjustable tool extender includes a reversible mechanism so that the user may continue working without having to readjust or switch tools.

Turning now descriptively to the drawing, referring to FIG. 1, a perspective view of an adjustable tool extender 100 is shown in accordance with an exemplary embodiment of the present invention. The adjustable tool extender 100 includes an elongated body 102 that is divided between a handle 104 and an extendable drive 106. The extendable drive 106 extends and retracts within the handle 104 to varying lengths. The far end of the extendable drive 106, from the handle 104, includes an engaging end 108 to insert into a coordinating tool bit. Similarly, at the far end of the handle 104, from the extendable drive 106, is a receiving end 110 to receive the head of a socket wrench. FIG. 1(A) illustrates a front view of the receiving end 110. The receiving end 110 includes a square recess 112 of a standard size to easily yet securely receive a drive on a socket wrench head. The engaging end 108 is shaped to fit within the tool bit, and may fit within the receiving end 110 in case more than one extender is needed for a job.

The extendable drive 106 moves in and out of the handle 104 in a telescopic manner. The handle 104 includes a means for locking 114. The means for locking 114 secures the engaging end 108 at various distances from the handle 104. The means for locking 114 may be spaced at ¼, ½, or 1 inch increments to lock the extendable drive 106 at very specific lengths within the handle 104. The means for locking 114 may include push button locks or twisting locks. The elongated body 102 may range from 4-18 inches in length depending on the length of the handle 104 and the extendable drive 106 and the extent that the extendable drive 106 is withdrawn from the handle 104.

With the adjustable tool extender 100 the user is able to work in hard to reach areas that would normally prevent normal socket wrench use. The adjustable tool extender 100 is available in sets with different sized engaging ends 108 and the receiving ends 110. For example, the engaging end 108 and the receiving end 110 are available in ¼, ⅜, ½, ¾ and 1 inch sizes. With the complete sets, the user does not have to exchange different extenders of different lengths while working. The user may simply select the adjustable tool extender 100 with the coordinating engaging end 108 and receiving end 110 as the tip and socket, and lengthen or shorten the extendable drive 106 within the handle 104 to the necessary length to complete the job.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An adjustable tool extender comprising:

a. an elongated body, where the elongated body is divided between a handle and an extendable drive;

b. an engaging end at a far end of the extendable drive, where the engaging end is adapted to receive a plurality of tool bits;

c. a receiving end at a far end of the handle, where the receiving end receives a drive on a tool; and d. a means for locking along the handle, where the series of locking means extend the extendable drive a distance from the handle, wherein the adjustable tool extender is available in a set of adjustable tool extenders.

2. The adjustable tool extender according to claim 1, where the extendable drive extends from the handle in a telescopic manner.

3. The adjustable tool extender according to claim 1, where the means for locking includes push button locks.

4. The adjustable tool extender according to claim 1, where the means for locking includes twist locks.

5. The adjustable tool extender according to claim 1, where the means for locking are spaced in one of at least ¼, ½ or 1 inch increments.

6. The adjustable tool extender according to claim 1, where the engaging end of a first adjustable tool extender fits into the receiving end of a second adjustable tool extender to enable further tool lengthening.

7. The adjustable tool extender according to claim 1, where the tool is a socket wrench.

* * * * *